US011892262B1

(12) United States Patent
Jones

(10) Patent No.: US 11,892,262 B1
(45) Date of Patent: Feb. 6, 2024

(54) FIREARM RECOIL MECHANISM

(71) Applicant: Tyler Paul Jones, Casselberry, FL (US)

(72) Inventor: Tyler Paul Jones, Casselberry, FL (US)

( * ) Notice: Subject to any disclaimer, the term of this patent is extended or adjusted under 35 U.S.C. 154(b) by 0 days.

(21) Appl. No.: 17/980,924

(22) Filed: Nov. 4, 2022

(51) Int. Cl.
*F41A 3/82* (2006.01)
*F41A 3/84* (2006.01)
*F41A 3/66* (2006.01)

(52) U.S. Cl.
CPC . *F41A 3/84* (2013.01); *F41A 3/66* (2013.01)

(58) Field of Classification Search
CPC ..... F41A 3/78; F41A 3/80; F41A 3/82; F41A 3/84; F41A 3/86; F41A 5/18
USPC ..... 89/199, 191.01–192, 194, 198; 42/1.06
See application file for complete search history.

(56) References Cited

U.S. PATENT DOCUMENTS 4,358,986 A * 11/1982 Giorgio ..... F41A 19/46 89/142
10,222,170 B2 * 3/2019 Bonine ..... F41A 3/84
11,248,862 B2 * 2/2022 Frazier ..... F41A 3/72
2011/0265639 A1 * 11/2011 Darian ..... F41A 21/484 42/16

FOREIGN PATENT DOCUMENTS

GB 2043845 A * 10/1980 ..... F41A 15/12

* cited by examiner

*Primary Examiner* — Reginald S Tillman, Jr.
(74) *Attorney, Agent, or Firm* — Steven C Stewart

(57) ABSTRACT

A firearm recoil mechanism is provided that includes a front spring plate integrally coupled with a Bolt Carrier Group. The front spring plate is slidably coupled with first and Second Guide Rods, where the first and Second Guide Rods extend through apertures in the front spring plate, first and second Recoil Springs engaging with the front spring plate, where the first Recoil Spring is disposed around the first Guide Rod, and where second Recoil Spring is disposed around the Second Guide Rod. A piston integrally coupled with the front spring plate and the Bolt Carrier Group. The piston and the front spring plate move with the Bolt Carrier Group in opposing directions while the first and Second Guide Rods remain stationary to coil and recoil the first Recoil Spring and second Recoil Spring on the first and Second Guide Rods, respectively.

12 Claims, 7 Drawing Sheets

FIREARM RECOIL MECHANISM

BACKGROUND

A Firearm Recoil Mechanism is disclosed for attaching to a rifle.

Short stroke gas piston systems have been used with a rifle such as an AK-47 type attack rifle. Such systems involve a piston which moves rearward as a result of gases in a rifle barrel in response to filing of a projectile. Such gases move the piston rearward to punch a bolt carrier group (BCG) backwards in a grove within an upper receiver in order to cycle reload of another projectile into the rifle's chamber.

The short stroke gas piston system has wear and tear on itself as a system. Although the BCG is riding in a grove it still tends to have carrier tilt problems. These prior rifles tend to have carbon build up inside the chamber and upper receiver thereby making them less reliable in extreme weather conditions. In addition, prior systems had parts moving against each other increasing wear.

Exemplary prior systems are disclosed in US Publication Nos. US 2018/0010879 A1, US 2022/0049912 A1, US 2021/0172692 A1, US 2021/0003357 A1, US 2021/0262746 A1; PCT Publication numbers WO 2021/013549 A1 and WO 2011/066893 A1; U.S. Pat. Nos. 4,807,512, 3,584,532, and Chinese publication number CN 111895853 A.

BRIEF SUMMARY

In one aspect, a firearm recoil mechanism operative to couple with a firearm, the firearm recoil mechanism includes a Bolt Carrier Group coupled with a front spring plate, the front spring plate slidably coupled with first and Second Guide Rods, where the first and Second Guide Rods operative to extend within a left channel and a right channel formed in an Upper Receiver and to extend through the front spring plate, first and second Recoil Springs engaging with the front spring plate, where the first Recoil Spring is disposed around the first Guide Rod, and where second Recoil Spring is disposed around the Second Guide Rod, a piston integrally coupled with the front spring plate and the Bolt Carrier Group, and the Upper Receiver forming a center guide channel in which the Bolt Carrier Group is operative to move through in a first direction to coil the first Recoil Spring and second Recoil Spring on the first and Second Guide Rods respectively in response to gases generated upon a firing of a bullet to push the piston and front spring plate in the first direction and to move the piston and front spring plate in a second opposite direction in response to a recoil of the first Recoil Spring and second Recoil Spring on the first and Second Guide Rods.

The firearm recoil mechanism may also include where the piston is operative to travel along the center guide channel with the front spring plate and Bolt Carrier Group in response to gases generated upon a firing of a bullet, and where the front spring plate forms a plurality of apertures to receive the first Guide Rod and the Second Guide Rod.

The firearm recoil mechanism may also include where the piston has threads at one end and the Bolt Carrier Group includes a threaded receiver, and where the piston is integrally coupled to the Bolt Carrier Group by screwing threads of the piston into the threaded receiver.

The firearm recoil mechanism may also include further includes a removably attachable Rear Spring Plate having a Rear Spring Plate Pin coupled to a back of the Upper Receiver.

In one aspect, an method for activating an attachment to an Adaptive Rifle Kinetic rifle (ARK Rifle) includes slidably attaching a Bolt Carrier Group to a front spring plate, and coupling the front spring plate to the first and Second Guide Rods, extending the first and Second Guide Rod within a left channel and a right channel formed in an Upper Receiver, forming with the Upper Receiver a center guide channel, engaging first and second Recoil Springs with the front spring plate, disposing the first Recoil Spring around the first Guide Rod, and the second Recoil Spring around the Second Guide Rod, integrally coupling a piston with the Bolt Carrier Group and the front spring plate, attaching the Upper Receiver to the ARK Rifle, moving the piston and front spring plate in a first direction along the first Guide Rod and the Second Guide Rod in response to gases generated upon a firing of a bullet with the ARK Rifle, in response to moving the piston in the first direction, moving the Bolt Carrier Group through the center guide channel and the front spring plate in the first direction to coil the first Recoil Spring and second Recoil Spring on the first and Second Guide Rods respectively, and moving the Bolt Carrier Group through the center guide channel and the front spring plate in a second direction opposite to the first direction in response to a recoil of the first Recoil Spring and second Recoil Spring on the first and Second Guide Rods pushing the front spring plate.

The method may also include further includes coupling a Rear Spring Plate with a Rear Spring Plate Pin to a back of the Upper Receiver and engaging the Rear Spring Plate with the first and Second Guide Rods.

The method may also include further includes extending the first and Second Guide Rods through apertures in the front spring plate in response to moving the Bolt Carrier Group and front spring plate in the first direction.

In one aspect, an Adaptive Rifle Kinetic (ARK) Rifle attachment includes a front spring plate integrally coupled with a Bolt Carrier Group, the front spring plate slidably coupled with first and Second Guide Rods, where the first and Second Guide Rods extend through apertures in the front spring plate, first and second Recoil Springs engaging with the front spring plate, where the first Recoil Spring is disposed around the first Guide Rod, and where second Recoil Spring is disposed around the Second Guide Rod, a piston integrally coupled with the front spring plate and the Bolt Carrier Group, and the piston and the front spring plate operative to move with the Bolt Carrier Group in a first direction while the first and Second Guide Rods remain stationary to coil the first Recoil Spring and second Recoil Spring on the first and Second Guide Rods respectively. The ARK Rifle attachment also includes the piston and front spring plate operative to move in a second opposite direction in response to a recoil of the first Recoil Spring and second Recoil Spring on the first and Second Guide Rods while the first and Second Guide Rods remain stationary.

The ARK Rifle attachment may also include further includes an Upper Receiver containing the front spring plate, the first and Second Guide Rod, and the first and second Recoil Spring, and a removably attachable Rear Spring Plate coupled with a back of the Upper Receiver, the first and second Recoil Spring and the first and Second Guide Rod.

The ARK Rifle attachment may also include where the center guide channel is positioned in the Upper Receiver between the left channel and the right channel.

The ARK Rifle attachment may also include having a Rear Spring Plate Pin coupled with the front spring plate and a back of the Upper Receiver. Other technical features may be readily apparent to one skilled in the art from the following figures, descriptions, and claims.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1A:
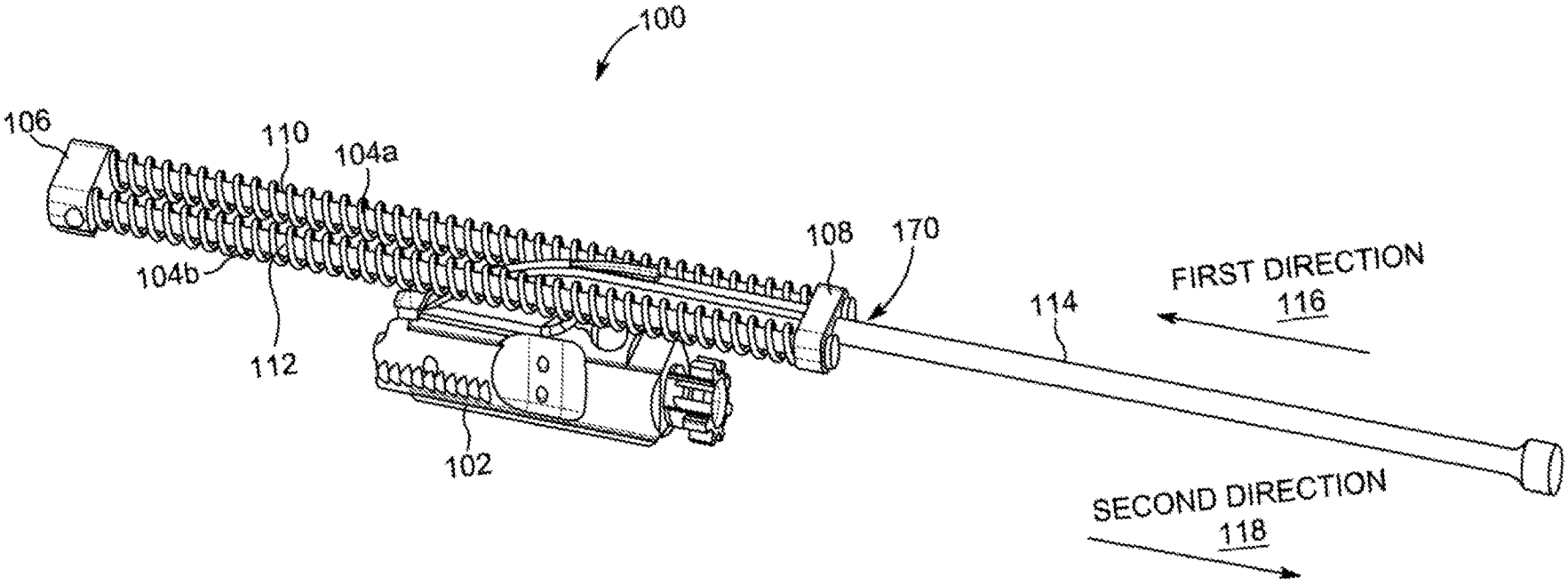
FIG. 1A illustrates a perspective view of a firearm recoil mechanism in accordance with one embodiment in a closed position.

There is shown a Firearm recoil mechanism 100 in a closed position. Firearm recoil mechanism 100 (Also referred to herein as an Adaptive Rifle Kinetic (ARK) rifle attachment) comprises a Bolt Carrier Group 102, a First Guide Rod 104*a* and Second Guide Rod 104*b*, and a Second Guide Rod 104*b*, Rear Spring Plate 106 and Front spring plate 108. The Bolt Carrier Group 102 slidably attaches to Front spring plate 108 which slidably couples with First Guide Rod 104*a* and Second Guide Rod 104*b*. The First Guide Rod 104*a* and Second Guide Rod 104*b* extend within a left channel and a right channel respectively formed in an Upper Receiver (See FIG. 2). One end of First Guide Rod 104*a* and Second Guide Rods 104*b* extend through apertures formed in front spring plate 108. The other end of First Guide Rod 104*a* and Second Guide Rods 104*b* are coupled with Rear Spring Plate 106.

A First Recoil Spring 110 and Second Recoil Spring 112 engage with the Bolt Carrier Group 102. The First Recoil Spring 110 is disposed around the First Guide Rod 104*a*. The Second Recoil Spring 112 is disposed around the Second Guide Rod 104*b*.

Bolt Carrier Group 102 is integrally coupled via aperture 170 in Front spring plate 108 with the piston 114 and with Front spring plate 108.

The Bolt Carrier Group 102 includes a first extension arm, and a second extension arm First extension arm is integrally coupled to Front spring plate 108. Second extension arm engages with Front spring plate 108. Front spring plate 108 engages with First Recoil Spring 110 and Second Recoil Spring 112.

The Upper Receiver forms a center guide channel in which the Bolt Carrier Group 102 moves and/or travels through in a first direction 116 to coil (compress) the First Recoil Spring 110 and Second Recoil Spring 112 on the First Guide Rods 104*a* and Second Guide Rods 104*b* respectively in response to gases generated upon a firing of a bullet with a firearm. Subsequently in response to a recoil of the First Recoil Spring 110 and Second Recoil Spring 112 on the First Guide Rods 104*a* and Second Guide Rods 104*b*, the First Recoil Spring 110 and Second Recoil Spring 112 pushes the piston 114 to move in a second direction 118 opposite to the first direction 116.

Figure 1B:
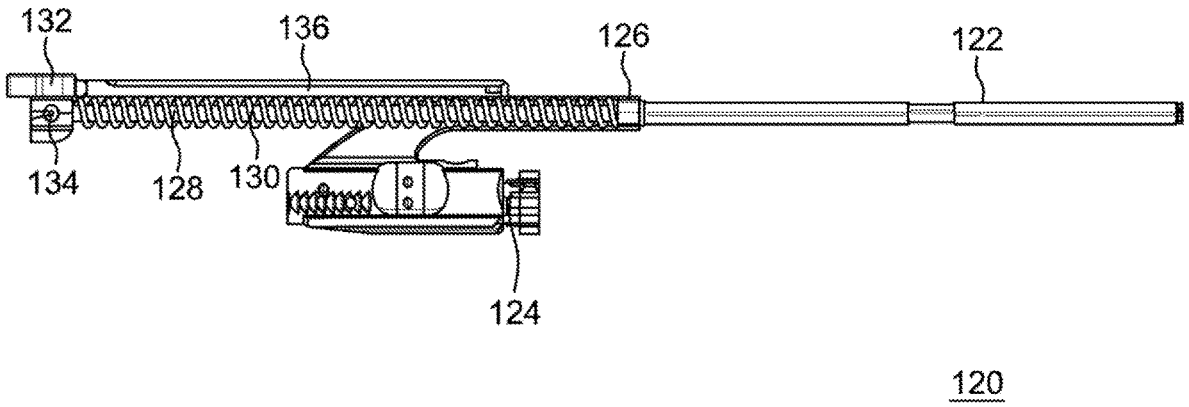
FIG. 1B illustrates a side plan view of the firearm recoil mechanism in accordance with one embodiment.

Referring to FIG. 1B, there is shown a side view of the Firearm recoil mechanism 120 in a closed position as shown in FIG. 1A. Firearm recoil mechanism 120 includes a piston 122 that engages with Bolt Carrier Group 124 and Front spring plate 126. A First and Second Guide Rod 128 extends through apertures formed in Front spring plate 126 and is surrounded by first and second Recoil Spring 130. A Rear Spring Plate 132 is coupled to one end of first and Second Guide Rod 128. A Rear Spring Plate Pin 134 is fed through an aperture in Rear Spring Plate 132 to connect Rear Spring Plate 132 to Upper Receiver (not shown). A Charging Handle 136 is mounted at one end to Rear Spring Plate 132 and extends over Upper Receiver.

Figure 1C:
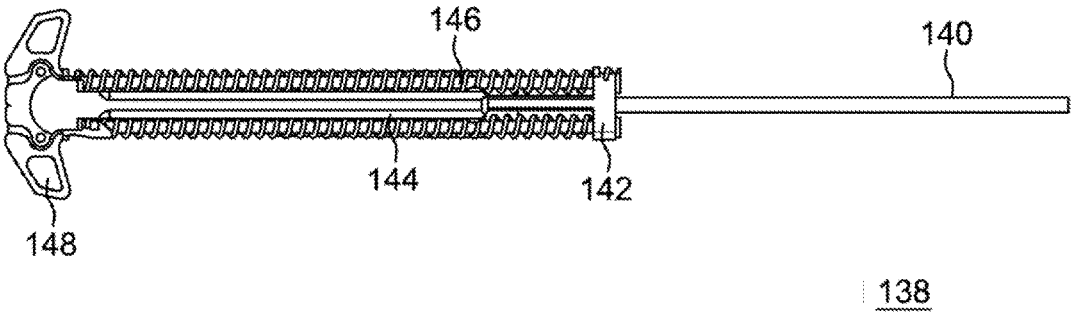
FIG. 1C illustrates a top plan view of the firearm recoil mechanism in accordance with one embodiment.

Referring to FIG. 1C, there is shown a side view of the Firearm recoil mechanism 138 in a closed position as shown in FIG. 1A and FIG. 1B. Firearm recoil mechanism 138 includes a piston 140 that engages with Bolt Carrier Group and Front spring plate 142. A First and Second Guide Rod 144 extends through apertures formed in Front spring plate 142. First and Second Guide Rod 144 are surrounded by first and second Recoil Spring 146. A Charging Handle 148 is mounted at one end to Rear Spring Plate (not shown) and extends over an Upper Receiver (See FIG. 2).

Figure 1D:
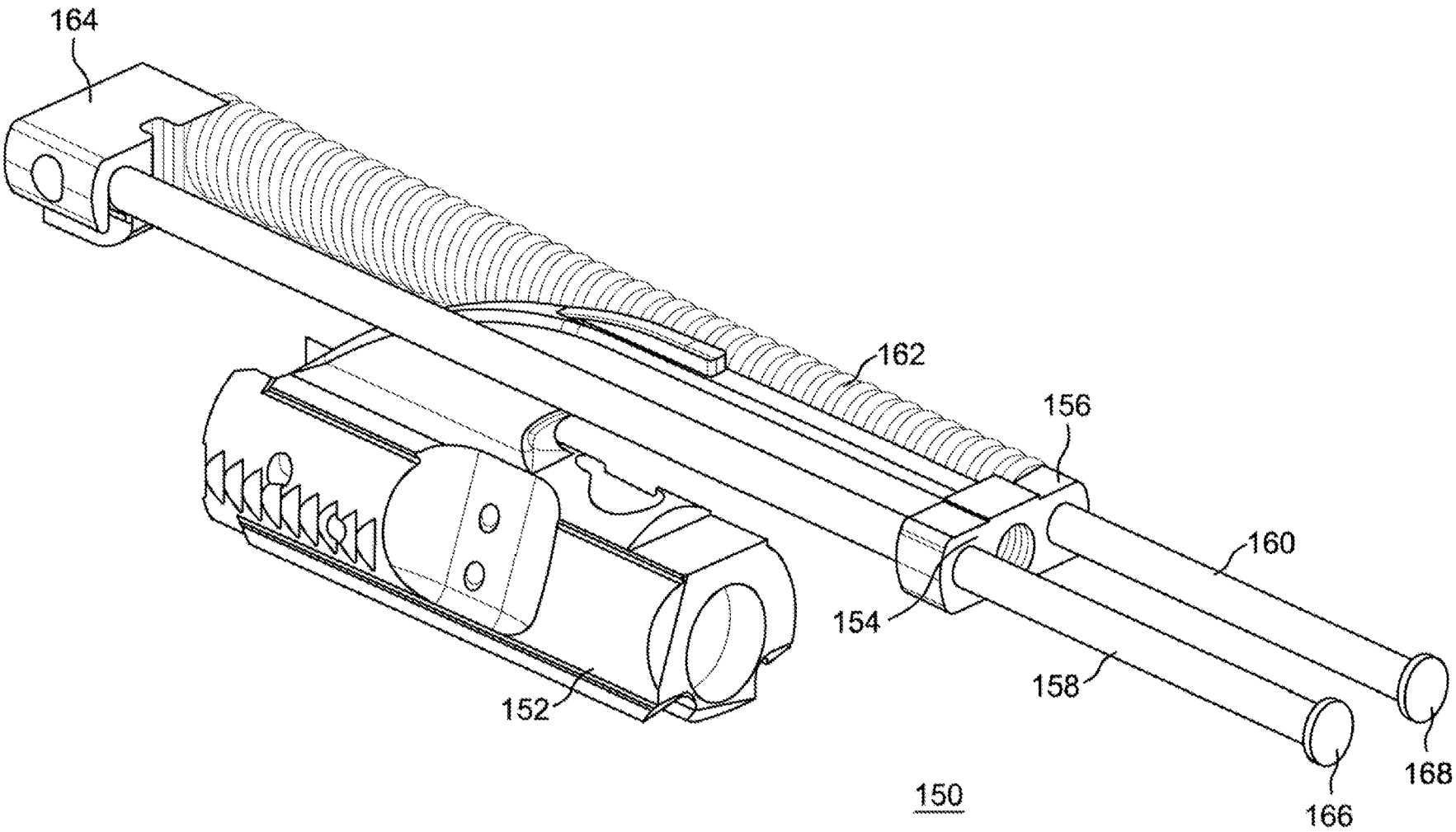
FIG. 1D illustrates a perspective view of a firearm recoil mechanism with a piston removed in accordance with one embodiment in an open position.

Referring to FIG. 1D, there is shown a Firearm recoil mechanism 150 in an open position (e.g., Immediately after a bullet has been fired) with a piston removed in accordance with one embodiment. Firearm recoil mechanism 150 includes the piston (not present) that engages with Bolt Carrier Group 152 through aperture 154 in front spring plate 156. A First Guide Rod 158 and Second Guide Rod 160 extend outward through apertures formed in Front spring plate 156 and are surrounded by a compressed first Recoil Spring (not shown) and second Recoil Spring 162. Preferably First Guide Rod 158 and Second Guide Rod 160 remain stationary during the firing process while bolt carrier group 152 and front spring plate 156 move. A Rear Spring Plate 164 is coupled to one end of first Guide Rod 158 and Second Guide Rod 160. One distal end of first Guide Rod 158 and 160 are First Guide Rod Front Lip 166 and Second Guide Rod Front Lip 168 respectively that function as a stop for front spring plate 156.

Figure 2:
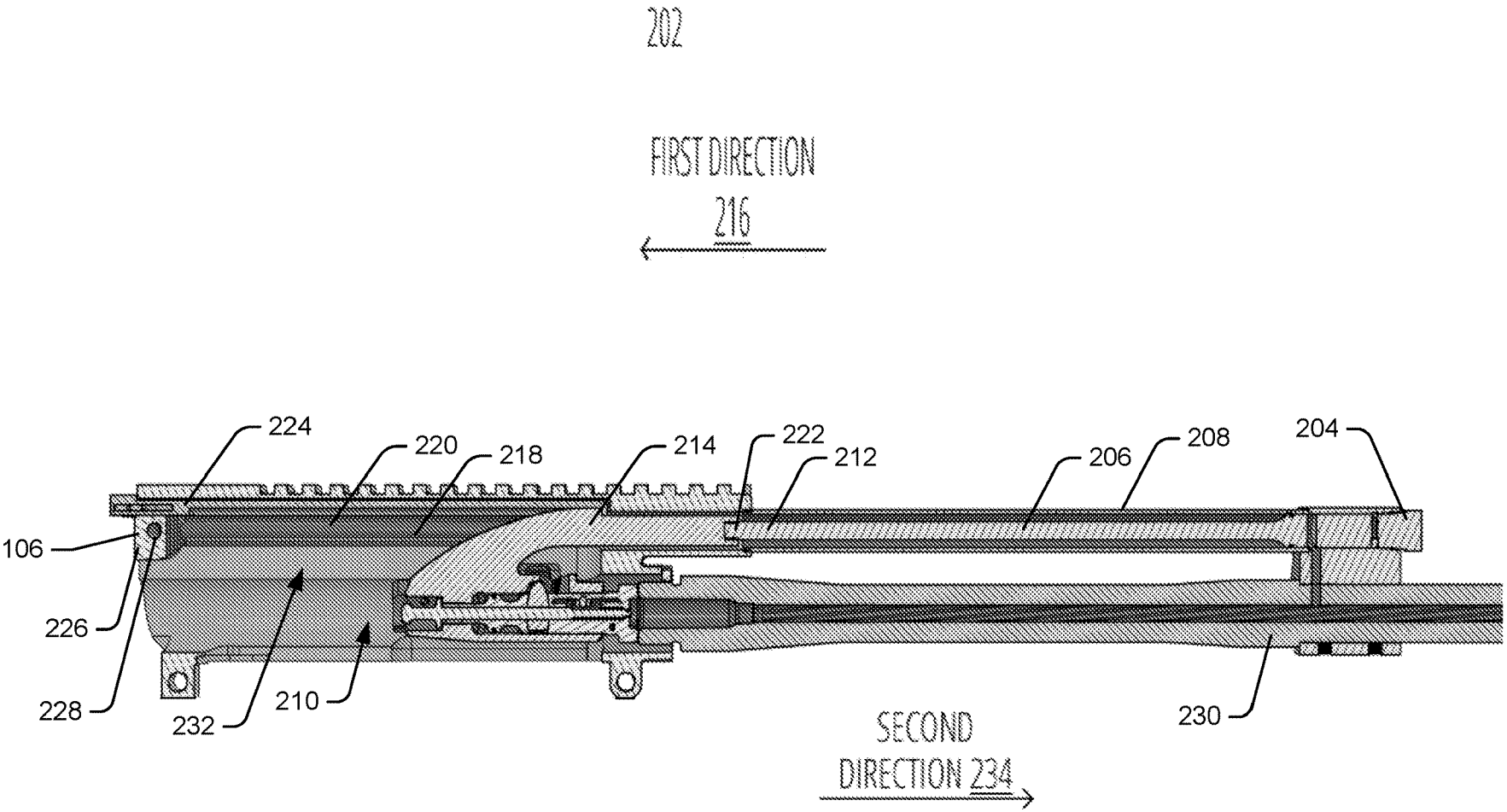
FIG. 2 illustrates side partially cutaway view of the firearm recoil mechanism in accordance with one embodiment.

Referring to FIG. 2, there is shown a Firearm recoil mechanism 202 that includes GAS Block 204 fitted to engage with the Piston 206. The Piston 206 at rest, when a rifle is in battery position, sits inside GAS Block 204. The Piston 206 then extends through Piston tube 208 to a point where the Piston tube 208 and the Piston 206 meet on Upper Receiver 210.

The Piston 206 extends slightly inside the Upper Receiver 210. Piston 206 is threaded at one end that screwably couples with threads 212 (also referred to herein as a threaded receiver) formed in the Bolt carrier group 214. As the Piston 206 and the Bolt carrier group 214 are threaded together and joined with Front spring plate 108, Piston 206 and Bolt carrier group 214 are dependent on each other. The Piston 206 and Front spring plate 108 move in a First direction 216 with Bolt carrier group 214.

At the top of the Bolt Carrier Group 214 are (left) first Second Guide Rod 218, (right) first Guide Rod (not shown)

and first Recoil Spring and Second Recoil Spring 220. The first and Second Guide Rods 218 on each side of the Bolt carrier group 214 may be inserted while the rifle is disassembled.

During assembly, the first Guide Rod and Second Guide Rod 218 are pushed through holes on each side of the Front spring plate 222 that is coupled with Bolt carrier group 214 until a lip or stopper (Not shown) adjacent one end of first and Second Guide Rod 218 engages with Front spring plate 108.

Once the first and Second Guide Rod 218 are installed the first and Second Recoil Spring 220 may be installed and slid overtop of the first and Second Guide Rod 218. When the first and Second Recoil Spring 220 are in place, the first and Second Recoil Spring 220 springs are compressed until a rear lip (not shown) on adjacent another end of the first and Second Guide Rod 218 slides into the Rear Spring Plate 106.

The assembled Firearm recoil mechanism 202 is operative to be inserted into the Upper Receiver 210. The Piston 206 is screwed in the aperture (piston hole) in Front spring plate 222 to engage with bolt carrier group 214. Charging Handle 224 is coupled to the top of the Upper Receiver 210. Once the Piston 206 is aligned and completely inside the Upper Receiver 210, the Rear Spring Plate 106 and Rear Spring Plate Pins 226 is placed into the rear pin hole 228.

Figure 3:
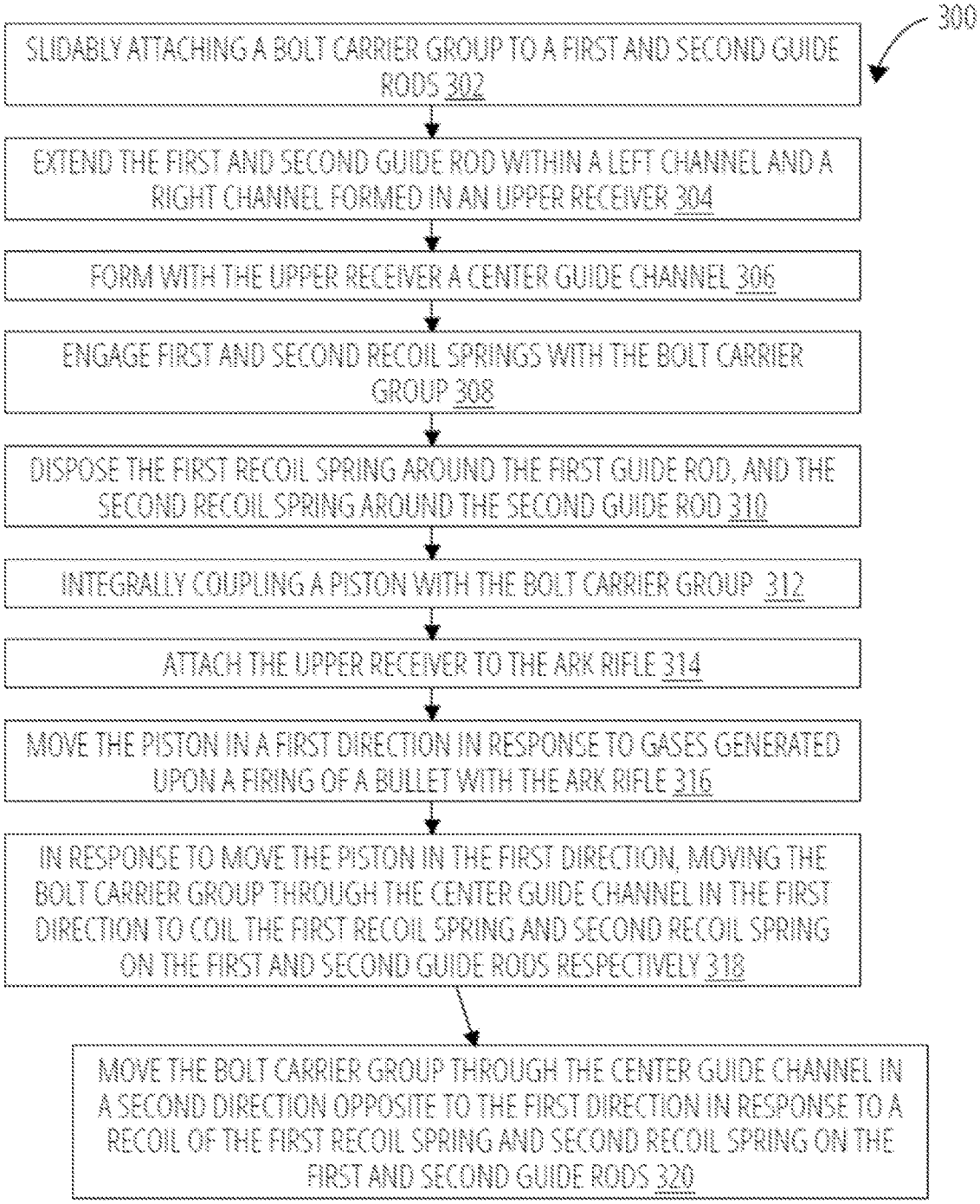
FIG. 3 illustrates a process for activating an attachment to an Adaptive Rifle Kinetic rifle (ARK Rifle) in accordance with one embodiment.

Illustrated in FIG. 3 is a method and/or process 300 for activating an attachment to an Adaptive Rifle Kinetic rifle (ARK Rifle). The exemplary process 300 in FIG. 3 is illustrated as a collection of blocks in a logical flow diagram, which represents a sequence of operations that can be implemented to perform the process. The order in which the operations are described is not intended to be construed as a limitation, and any number of the described blocks can be combined in any order and/or in parallel to implement the process 300. For discussion purposes, the processes 300 are described with reference to FIG. 2, although it may be implemented in other diagrams shown.

Referring to FIG. 3, there is shown process 300 for activating an attachment to an Adaptive Rifle Kinetic rifle (ARK Rifle).

In block 302, a Bolt carrier group 214 is slidably attached to a first and Second Guide Rods 218.

In block 304, the first and Second Guide Rod 218 are extended within a left channel and a right channel formed in an Upper Receiver 210.

In block 306, the Upper Receiver 210 forms a center guide channel.

In block 308, a first and Second Recoil Springs 220 engages with the Bolt Carrier Group.

In block 310, the first Second Recoil Spring 220 is disposed around the First Guide Rod 104*a*, and the Second Recoil Spring 112 around the Second Guide Rod 218.

In block 312, Piston 206 is integrally coupled with the Bolt carrier group 214.

In block 314, the Upper Receiver 210 is attached to the Firearm recoil mechanism 202 including the barrel 230 and a GAS Block 204 to form an ARK Rifle.

In block 316, the Piston 206 is moved in a First direction 216 in response to gases generated upon a firing of a bullet with the ARK Rifle.

In block 318, in response to movement of the Piston 206 in the First direction 216, the bolt carrier group 214 travels through a center guide channel 232 in the First direction 216 to coil the first and Second Recoil Spring 220 on the first and Second Guide Rods 218, respectively.

In block 320, the Bolt carrier group 214 moves through the center guide channel 232 in a Second Direction 234 opposite to the First direction 216 in response to a recoil of the first and Second Recoil Spring 220 on the first and Second Guide Rod 218.

Figure 4A:
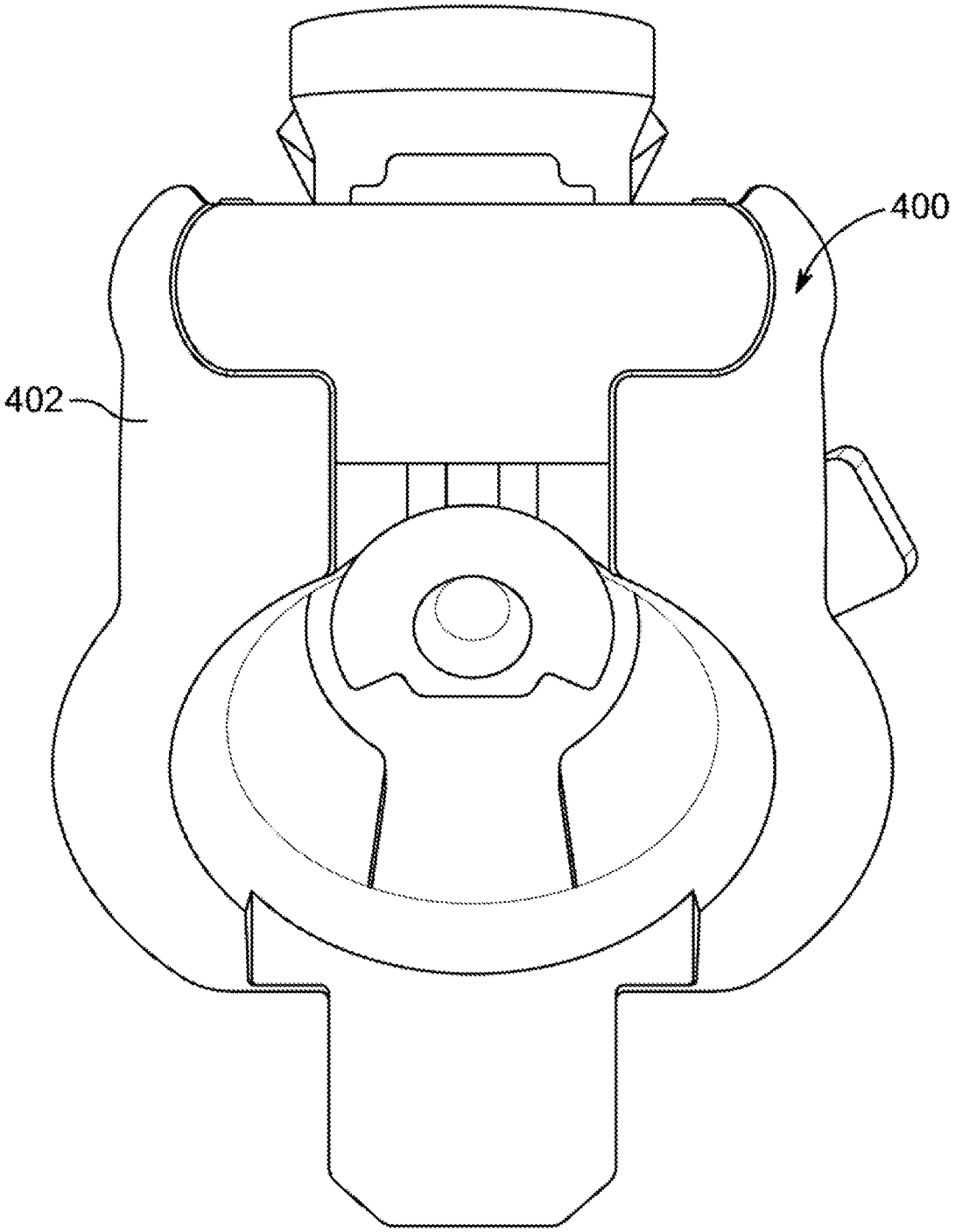
FIG. 4A illustrates an aspect of the subject matter in accordance with one embodiment.

Referring to FIG. 4A there is shown a Rear Spring Plate 400 that is removable and slides into a groove of a rear portion of Upper Receiver 402.

Figure 4B:
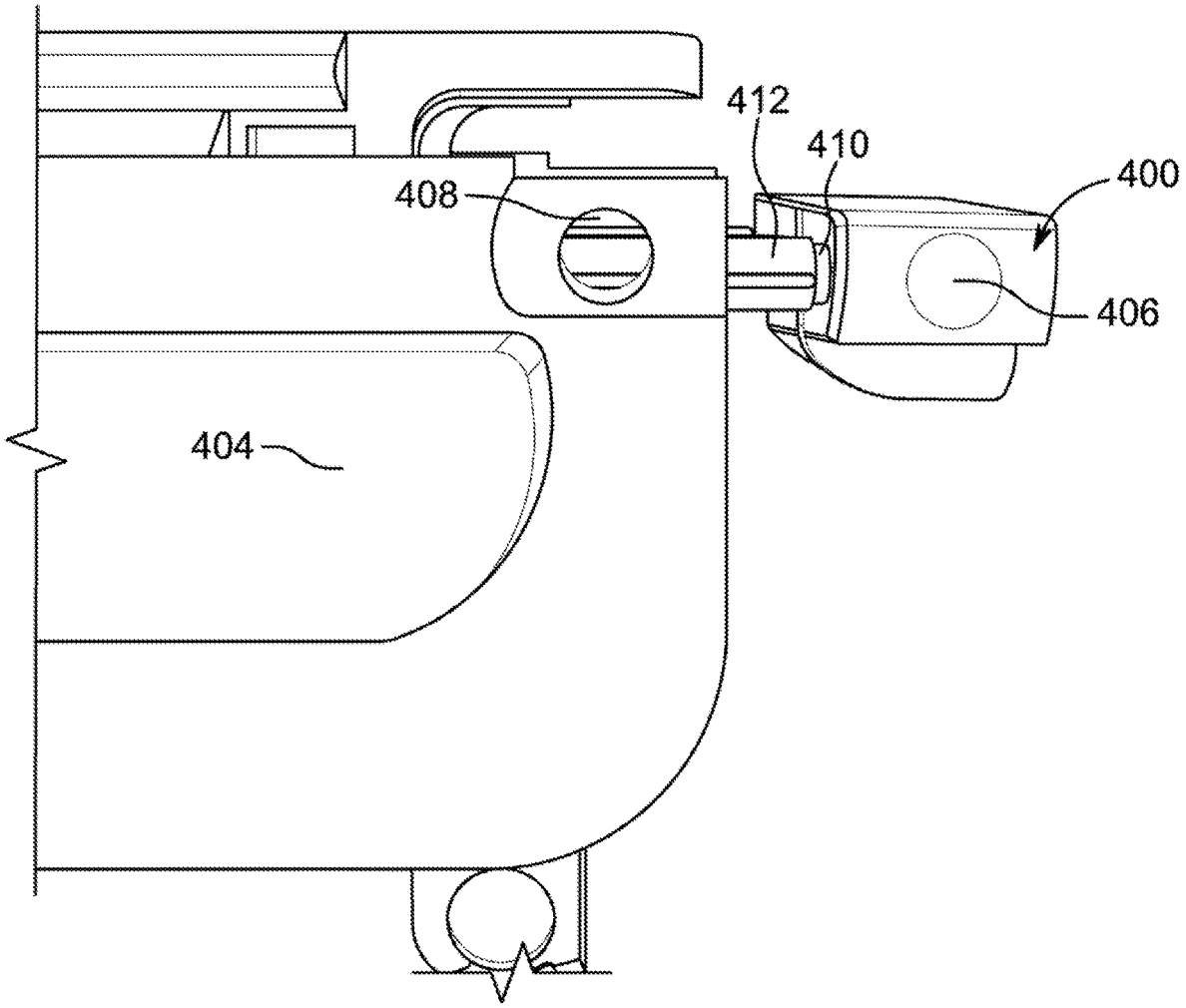
FIG. 4B illustrates an aspect of the subject matter in accordance with one embodiment.

Referring to FIG. 4B, there is shown a side view of an Upper Receiver 404 that receives a Rear Spring Plate 400. Rear Spring Plate 400 forms a rear pin hole 406 on its outside edges that when inserted into a back or rear portion of the Upper Receiver 404 align with Upper Receiver aperture 408. Rear Spring Plate 400 forms void 410 for receiving First and Second Guide Rod 412. When Rear Spring Plate 400 is inserted into Upper Receiver 404 such that the rear pin holes 406 align with rear pin holes 406, a Rear Spring Plate Pin may be inserted therethrough to attach Rear Spring Plate 400 to Upper Receiver 404.

While the above detailed description has shown, described and identified several novel features of the invention as applied to a preferred embodiment, it will be understood that various omissions, substitutions and changes in the form and details of the described embodiments may be made by those skilled in the art without departing from the spirit of the invention. Accordingly, the scope of the invention should not be limited to the foregoing discussion but should be defined by the appended claims.

What is claimed is:

1. A firearm recoil mechanism operative to couple with a firearm, the firearm recoil mechanism comprising:

a Bolt Carrier Group coupled with a front spring device, the front spring device slidably coupled with a first Guide Rod and a Second Guide Rod, wherein the first Guide Rod and the Second Guide Rod operative to extend within a left channel and a right channel formed in an Upper Receiver and to extend through the front spring device;

a First Recoil Spring and a second Recoil Springs engaging with the front spring device, wherein the first Recoil Spring is disposed around the first Guide Rod, and wherein second Recoil Spring is disposed around the Second Guide Rod;

a piston, integrally coupled with the front spring device and the Bolt Carrier Group, configured to directly respond to gases generated upon a firing of a bullet by traveling with the Bolt Carrier Group in a first direction and a second opposite direction; and the Upper Receiver forming a center guide channel in which the Bolt Carrier Group is operative to move through in the first direction to coil the first Recoil Spring and second Recoil Spring on the first and Second Guide Rods respectively in response to gases generated upon a firing of a bullet to push the piston and front spring device in the first direction and to move the piston and front spring device in the second opposite direction in response to a recoil of the first Recoil Spring and second Recoil Spring on the first and Second Guide Rods.

2. The firearm recoil mechanism of claim 1 wherein the piston is operative to travel along the center guide channel with the front spring device and Bolt Carrier Group in response to gases generated upon a firing of a bullet, and wherein the front spring device forms a plurality of apertures to receive the first Guide Rod and the Second Guide Rod.

3. The firearm recoil mechanism of claim 2 wherein the center guide channel is positioned in the Upper Receiver between the left channel and the right channel.

4. A firearm recoil mechanism operative to couple with a firearm, the firearm recoil mechanism comprising:

a Bolt Carrier Group coupled with a front spring plate, the front spring plate slidably coupled with a first Guide Rod and a Second Guide Rod, wherein the first Guide Rod and the Second Guide Rod operative to extend within a left channel and a right channel formed in an Upper Receiver and to extend through the front spring plate;

a First Recoil Spring and a second Recoil Springs engaging with the front spring device, wherein the first Recoil Spring is disposed around the first Guide Rod, and wherein second Recoil Spring is disposed around the Second Guide Rod;

a piston integrally coupled with the front spring plate and the Bolt Carrier Group; and the Upper Receiver forming a center guide channel in which the Bolt Carrier Group is operative to move through in a first direction to coil the first Recoil Spring and second Recoil Spring on the first and Second Guide Rods respectively in response to gases generated upon a firing of a bullet to push the piston and front spring device in the first direction and to move the piston and front spring plate in a second opposite direction in response to a recoil of the first Recoil Spring and second Recoil Spring on the first and Second Guide Rods, wherein the piston has threads at one end and the Bolt Carrier Group includes a threaded receiver, and wherein the piston is integrally coupled to the Bolt Carrier Group by screwing threads of the piston into the threaded receiver.

5. The firearm recoil mechanism of claim 1 further comprising a removably attachable Rear Spring Plate engaging with a Rear Spring Plate Pin coupled to a back of the Upper Receiver.

6. A method for activating an attachment to an Adaptive Rifle Kinetic rifle (ARK Rifle) comprising:

slidably attaching a Bolt Carrier Group to a front spring unit, and coupling the front spring plate to a first guide rod and a Second Guide Rod, extending the first Guide Rod and the Second Guide Rod within a left channel and a right channel formed in an Upper Receiver;

forming with the Upper Receiver a center guide channel;

engaging a first Recoil Spring and a second Recoil Spring with the front spring unit;

disposing the first Recoil Spring around the first Guide Rod, and the second Recoil Spring around the Second Guide Rod;

integrally coupling a piston with the Bolt Carrier Group and the front spring unit;

attaching the Upper Receiver to the ARK Rifle;

moving the piston and the front spring unit in a first direction along the first Guide Rod and the Second Guide Rod in response to gases generated upon a firing of a bullet with the ARK Rifle;

in response to moving the piston in the first direction, moving the Bolt Carrier Group through the center guide channel and the front spring unit in the first direction to coil the first Recoil Spring and second Recoil Spring on the first and Second Guide Rods respectively; and moving the Bolt Carrier Group through the center guide channel, the front spring unit and the piston in a second direction opposite to the first direction in response to a recoil of the first Recoil Spring and second Recoil Spring on the first and Second Guide Rods pushing the front spring unit.

7. The method of claim 6 further comprising:

coupling a Rear Spring Plate with a Rear Spring Plate Pin to a rear portion of the Upper Receiver; and engaging the Rear Spring Plate with the first Guide Rod and the Second Guide Rod.

8. The method of claim 6 further comprising extending the first and Second Guide Rods through apertures in the front spring unit in response to moving the Bolt Carrier Group and the front spring unit in the first direction.

9. An Adaptive Rifle Kinetic (ARK) Rifle attachment comprising:

a front spring device integrally coupled with a Bolt Carrier Group;

the front spring device slidably coupled with first and Second Guide Rods, wherein the first and Second Guide Rods extend through apertures in the front spring device;

first Recoil Spring and second Recoil Spring engaging with the front spring device, wherein the first Recoil Spring is disposed around the first Guide Rod, and wherein second Recoil Spring is disposed around the Second Guide Rod;

a piston coupled with the front spring device and the Bolt Carrier Group;

the piston and the front spring plate device are configured to move together with the Bolt Carrier Group in a first direction while the first and Second Guide Rods remain stationary to coil the first Recoil Spring and second Recoil Spring on the first and Second Guide Rods respectively; and the piston and the front spring device operative to move together with the Bolt Carrier Group in a second opposite direction in response to a recoil of the first Recoil Spring and second Recoil Spring on the first and Second Guide Rods while the first and Second Guide Rods remain stationary.

10. The Adaptive Rifle Kinetic (ARK) Rifle of claim 9 further comprising:

an Upper Receiver engaging with the front spring device, the first and Second Guide Rod, and the first and second Recoil Spring; and a removably attachable Rear Spring Plate coupled with the Upper Receiver, the first and second Recoil Spring and the first and Second Guide Rod.

11. The Adaptive Rifle Kinetic (ARK) Rifle of claim 10 comprising a Rear Spring Plate Pin coupled with the front spring device and on the Upper Receiver.

12. The Adaptive Rifle Kinetic (ARK) Rifle of claim 9, wherein the piston has threads and the Bolt Carrier Group includes a threaded receiver, and wherein the piston is coupled to the Bolt Carrier Group by screwing threads of the piston into the threaded receiver.

* * * * *